US005518478A

United States Patent [19]

Liang

[11] Patent Number: 5,518,478

[45] Date of Patent: May 21, 1996

[54] DUMBBELL

[76] Inventor: Yung-Jen Liang, No. 76, An Ler Street, Ah Dong Tsuen, Hsue Hsai Hsiang, Chang Hua Hsien, Taiwan

[21] Appl. No.: 441,122

[22] Filed: May 15, 1995

[51] Int. Cl.[6] ..... A63B 21/072; A63B 21/075

[52] U.S. Cl. ..... 482/108; 482/105; 482/107

[58] Field of Search ..... 482/106, 107, 482/108, 105, 148

[56] References Cited

U.S. PATENT DOCUMENTS

| | | | |
|---|---|---|---|
| 1,524,888 | 2/1925 | Schuur | 482/108 |
| 4,566,690 | 1/1986 | Schook | 482/108 |
| 4,627,618 | 12/1986 | Schwartz | 482/108 |
| 5,090,693 | 2/1992 | Liang | 482/108 |
| 5,407,413 | 4/1995 | Kupferman | 482/108 |

*Primary Examiner*—Stephen R. Crow
*Attorney, Agent, or Firm*—Charles E. Baxley

[57] ABSTRACT

A dumbbell includes a handle, two blocks secured to the ends of the handle, and two casings engaged on the blocks so as to adjust the weight of the dumbbell. Two projections are engaged in the blocks and engaged with the casings for securing the casings to the blocks. Two housings are engaged on the casings and include two projections for securing the housings to the casings so as to further adjust the weight of the dumbbell. An arm is engaged onto the handle for engaging with the hands and legs of the users so as to conduct various kinds of exercises.

1 Claim, 3 Drawing Sheets

DUMBBELL

BACKGROUND OF THE INVENTION

1. Field of the Invention

The present invention relates to a dumbbell, and more particularly to a dumbbell that may be adjusted to different weights.

2. Description of the Prior Art

Typical dumbbells comprise a handle having two weights secured to the end portions of the handle. The handle and the weights are solidly secured together and may not be adjusted to different weights.

The present invention has arisen to mitigate and/or obviate the afore-described disadvantages of the conventional dumbbells.

SUMMARY OF THE INVENTION

The primary objective of the present invention is to provide a dumbbell which may be adjusted to different weights according to the user's need.

In accordance with one aspect of the invention, there is provided a dumbbell comprising a handle including two ends, two blocks secured to the ends of the handle, and at least one casing means engaged on the blocks so as to adjust the weight of the dumbbell.

The casing means includes two casings each having an opening formed therein for engaging with the blocks, and includes projection means for securing the casings to the blocks.

The casing means further includes two housings engaged on the casings, and includes projection means for securing the housings to the casings so as to further adjust the weight of the dumbbell.

An arm includes a leg engaged onto the handle and includes a longitudinal body arranged in parallel to the handle.

A sleeve is engaged onto the arm and including an aperture formed therein for engaging with the handle.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
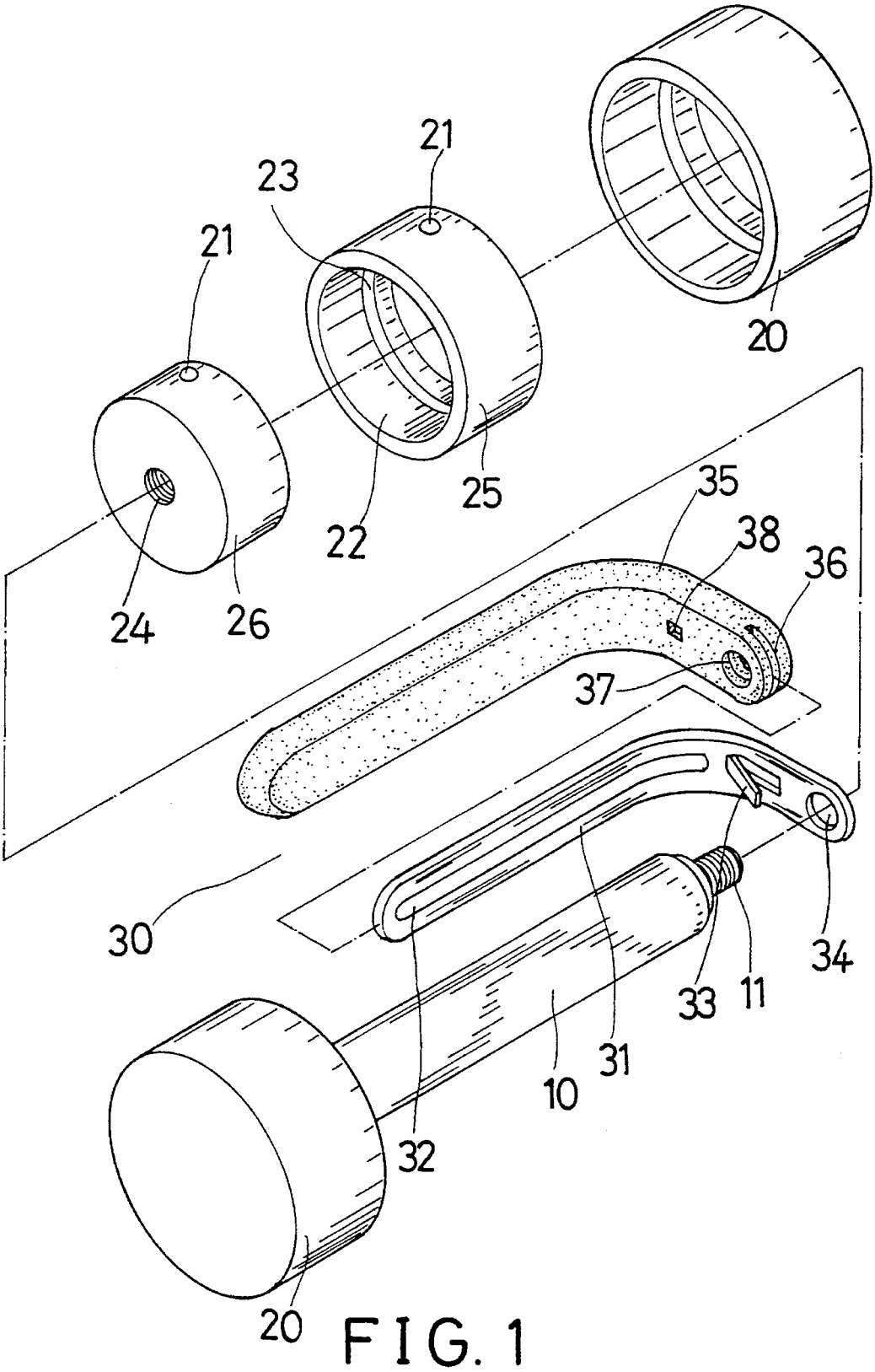
FIG. 1 is an exploded view of a dumbbell in accordance with the present invention.
Figure 2:
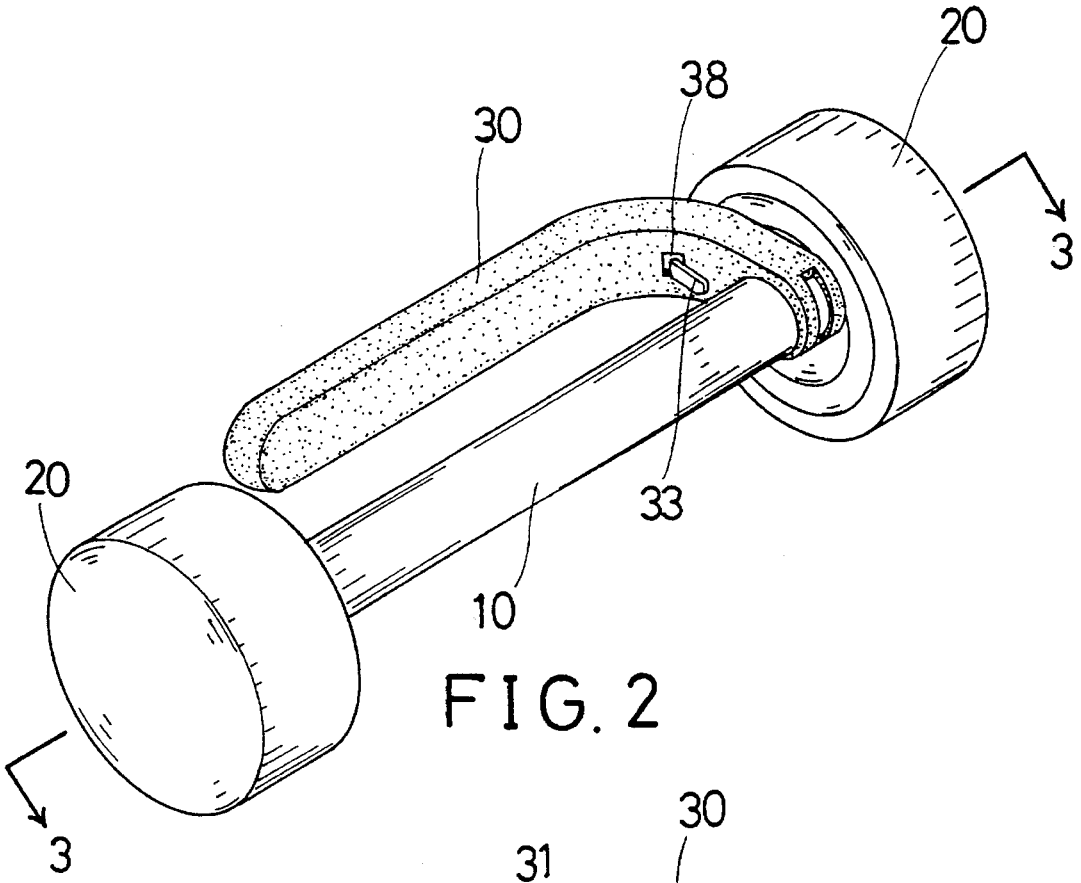
FIG. 2 is a perspective view of the dumbbell.
Figure 3:
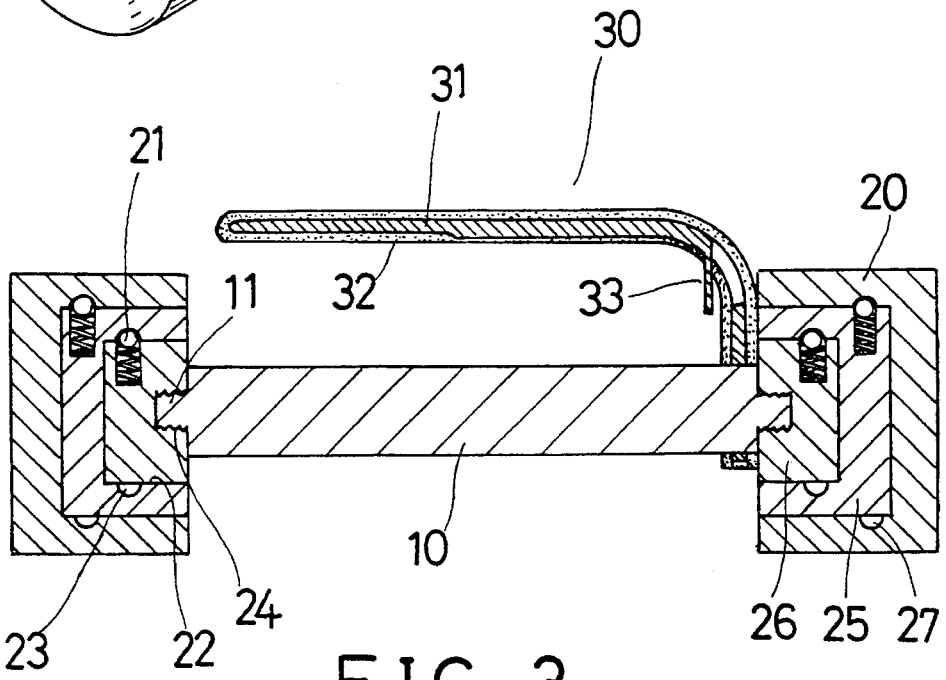
FIG. 3 is a cross sectional view taken along lines 3—3 of FIG. 2.

Referring to the drawings, and initially to FIGS. 1 to 3, a dumbbell in accordance with the present invention comprises a handle 10 including two ends each having an outer thread 11 formed thereon for engaging with the inner threads 24 of two blocks 26 respectively. The blocks 26 each includes a projection means 21 engaged therein. Two casings 25 each includes an opening 22 formed therein for engaging onto the blocks 26 and each includes an annular groove 23 formed therein for engaging with the projection means 21 such that the casings 25 can be stably secured to the blocks 26 so as to adjust the weight of the dumbbell. The casings 25 each also includes a projection means 21 engaged therein for engaging with an annular slot 27 formed in a housing 20. The housing 20 are engaged onto the casings 25 and the annular slots 27 of the housings 20 are engaged with the projection means 21 of the casings 25 so as to secure the housings 20 to the casings 25 and so as to further adjust the weight of the dumbbell.

An L-shaped arm 31 includes a reinforcing rib 32 formed in a longitudinal body and includes an orifice 34 formed in a leg which is substantially perpendicular to the longitudinal body for engaging with the end portions of the handle 10. A sleeve 35 is engaged on the arm 31 (FIG. 3) and includes a passage 36 for engaging with the arm 31. The sleeve 35 includes an aperture 37 for engaging with the end portions of the handle 10, and includes a hole 38 formed therein for engaging with an extension 33 which are punched from the arm 31.

Figure 4:
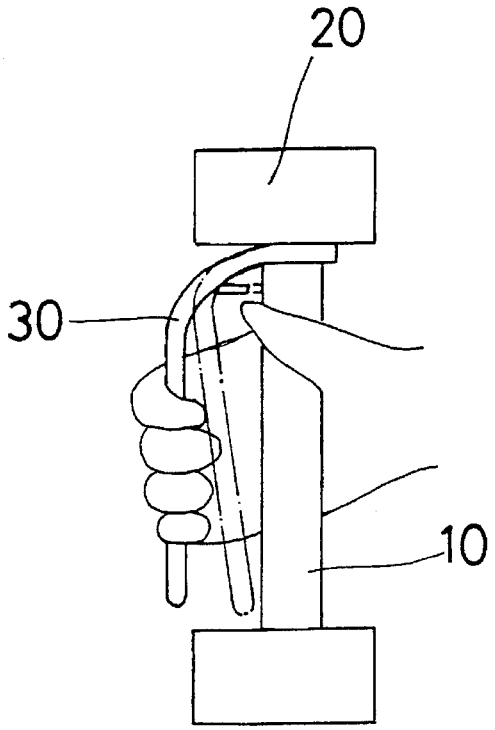
FIGS. 4 and 5 are schematic views illustrating the operations of the dumbbell.
Figure 5:
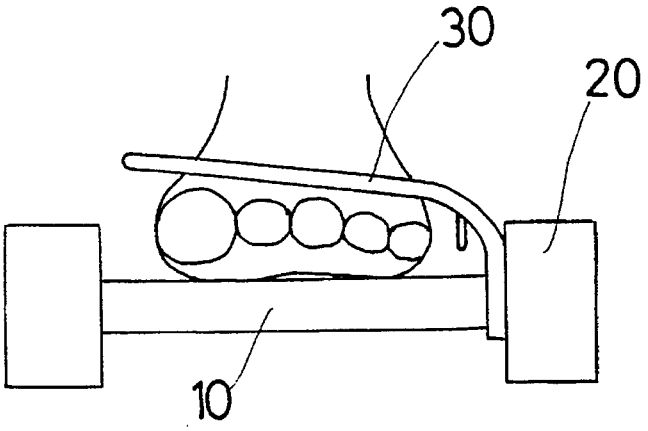

In operation, as shown in FIG. 4, the user may hold both the arm 31 and the handle 10 for exercising the hands thereof. The extension 33 is provided for engaging with the handle 10 so as to limit the bending movement of the arm 31. As shown in FIG. 5, the feet of the user may be engaged between the arm 31 and the handle 10 for exercising purposes. It is to be noted that the casings 25 and the housings 20 may be engaged onto the blocks 26 so as to adjust the weight of the dumbbell.

Accordingly, the dumbbell in accordance with the present invention may be adjusted to different weights according to the user's need and includes an arm for engaging with the hands and the feet of the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A dumbbell comprising:

a handle including two ends, two blocks secured to said ends of said handle, said blocks each including an outer peripheral portion having a first projection means provided therein, at least two casings each including an opening formed therein for engaging onto said blocks and for receiving said blocks therein, said casings each including an annular groove formed therein for engaging with said first projection means so as to secure said casings to said block, said casings each including an outer peripheral portion having a second projection means provided therein, two housings for engaging onto said casings and for receiving said casings therein, said housings each including an annular slot formed therein for engaging with said second projection means so as to secure said housings to said casings, an arm including a leg engaged onto said handle and including a longitudinal body arranged in parallel to said handle, said arm including an extension extended therefrom for engaging with said handle so as to limit a bending of said arm, and a sleeve including a passage formed therein for engaging with said arm and including an aperture formed therein for engaging with said handle, and including a hole formed therein for engaging with said extension.

* * * * *